United States Patent [19]

Johnson

[11] Patent Number: 4,878,478

[45] Date of Patent: Nov. 7, 1989

[54] WOOD BURNING STOVE

[76] Inventor: Darrel Johnson, 320 - 11th St., Lewiston, Id. 83501

[21] Appl. No.: 170,804

[22] Filed: Mar. 21, 1988

[51] Int. Cl.[4] ..... F24C 1/14

[52] U.S. Cl. ..... 126/61; 126/531; 126/66; 126/77; 126/67

[58] Field of Search ..... 126/121, 123, 126, 58, 126/66, 60, 61, 77, 67, 531

[56] References Cited

U.S. PATENT DOCUMENTS

| | | | |
|---|---|---|---|
| 3,976,047 | 8/1986 | Breen et al. . | |
| 4,015,851 | 4/1981 | Martenson . | |
| 4,147,153 | 4/1979 | Buckner . | |
| 4,210,119 | 7/1980 | Kincaid | 126/61 |
| 4,320,740 | 3/1982 | Lassey et al. . | |
| 4,320,741 | 3/1982 | Pierce | 126/61 |
| 4,465,055 | 8/1984 | Bortz | 126/126 |
| 4,621,610 | 11/1986 | Tomooka | 126/61 |
| 4,643,165 | 2/1987 | Chamberlain | 126/60 |

FOREIGN PATENT DOCUMENTS

WO85/03762 8/1985 PCT Int'l Appl. .

*Primary Examiner*—Randall L. Green

[57] ABSTRACT

A stove with a continuously open draft provides a fire chamber peripherally configured to cause circular motion of burning gases therein to provide substantially complete combustion of fuel. A continuously open elongate draft vent is positioned above and immediately inwardly of a door window to aid cleaning of that structure and to reinforce the circular motion of combustion gases. Baffles and exhaust dampers also are configured to aid the circular motion of combustion gases in the fire chamber. Heated surfaces defining the upper fire chamber walls catalyze the combustion reaction and rearward surfaces reflect radiant energy back into the combusting fuel to further aid combustion.

7 Claims, 2 Drawing Sheets

WOOD BURNING STOVE

BACKGROUND OF INVENTION

1. RELATED APPLICATIONS

There are no applications related hereto heretofore filed in this or any foreign country.

FIELD OF INVENTION

My invention relates generally to wood burning stoves and more particularly to such a stove having particular firebox, draft, and exhaust structures configured to cause rotary motion of combustion gases in the fire chamber for more complete combustion.

BACKGROUND OF INVENTION AND PRIOR ART

Stoves and particularly fireplace inserts have become popular, both socially and economically, in the recent past and responsive to such popularity the devices have increased substantially in number, to such an extent that they have become an environmental and ecological problem. Because of this, such stoves in general, and especially wood burning stoves, have often been controlled by various governmental authorities having jurisdiction over them, and as the number of stoves has increased, the controls concerning them have proportionately increased in areal coverage, detail and stringency.

With such happenings, what was once a simple structure that begot a supposedly simple combustion reaction has become quite complex in both structure and function. Responsively, a new generation of wood burning stoves has arisen to meet both the governmental regulations and practical restrictions placed upon them by their users. The instant invention seeks to epitomize various structural refinements, some of which have heretofore been rudimentarily developed, and synergistically combine them to provide a stove with clean burning characteristics approaching the potential limits for such a device, and in fact to set a design standard for such devices.

In general, the combustion of wood in a stove is a complex chemical process that extends over a discrete period of time which commonly is longer than the average time that incompletely oxidized combustion products remain within the combusion chamber. In general, wood fuel in a solid form firstly becomes involved in the combustion process and the heat of this initial combustion createss gaseous products that further oxidize to more fully complete the process. Preferably the ideal completed combustion cycle should provide a maximum of corbon dioxide and water and a minimum of unburned organic gases and suspended particulates. Present day regulatory standards in general set limits not only upon the efficiency of heat outut of stoves, but also upon other parmeters such as output of particulates, carbon monoxide and carbon dioxide to determine efficiency.

Obviously the longer combustion gases remain in a fire chamber the further their combustion restion will proceed toward completion and such residence time in a fire chamber has lomg been used to create greater combustion efficiency, such as in the down draft type fire chamber or some form of forced draft chamber which creates particular combustion gas pathways, and especially those having a swirling or circulatory motion of one sort or another. The instant invention uses this circulatory principle to aid in completing combustion, but in so doing provides a circulating pattern that is in the form of a cylinder with a horizontal axis as oposed to more vertically oriented patterns, such as the typical swirling vortex or other similar vertically oriented motion. The circulation cylinder of the instant invention has sufficienta vertically oriented upward motion at its lateral periphery to allow exhaust products to exit, yet is quite efficient in maintaining combustion gases within the fire chamber for substantial periods of time. It in general will also maintain the less oxidized and generally cooler gases in the medial portion of the circulation cylinder with the more highly combusted and hotter gases at the exterior, from whence they are morae readily exhausted. This function is accomplished by the particular shape of my fire chamber and the relation of dampers, baffles and drafts to that particular shape. In general, this pattern of circulation of combustion gases in prior stoves has not been well or efficiently developed, if in fact the circulation has not beaen randomly orientated.

In general, it is both a social and pracatical desire in wood burning stove inserts to have some sort of a transparent window through which the combustion process may be observed. Normally in most stoves this window is in a door that also serves as a means of fueling the stove. Commonly such windows, especially in high efficiency wood burning stoves, collect soot, other particulate matter or condensates on their inner surface to lessen transparency, and sometimes even render the window opaque. Various attempts have been made to prevent such deposits and heretofore these efforts generally have taken some form of so-called "washing" by combustion gases from within the fire chamber. This process is more or less operative, but it has the disadvantage of heating the window material to relatively high temperatures that may cause physical damage to the window material itself. My invention provides a washing system which is more efficient because of its nature in using higher temperature gases. Higher temperatures are allowed without causing window damage by use of a ceramic-glass material for the window. This type of high temperature washing is accomplished by my particular draft structure which inputs draft air above and just rearwardly of the window to accentuate combustive washing action in this area.

My draft constitutes an elongate slit, above and immediataely rearwardly of the front door of a stove, divided lengthwise by a particularly configured curvilinear divider to cause turbulaence between its two input draft streams to enhance combustion in and adjacent the input streams. The draft has no damper but rather is continuously open. This draft configuration not only aids an efficient window washing function, but also aids in creating and maintaining the pattern of cylindrical combustion gas motion, as the draft is parallel to the cylindical pattern and located above and substantially tangentially to the periphery of that cylinder, in contradistinction to most prior drafts. The open nature of the draft, without closable dampers, removes one user controlled variable from the combustion process to make that process more simply determinable than prior art drafts. My draft structure also requires adjustment of the combustion reaction from the exhaust dampers to prevent a user from creating an inadequate oxygen supply to allow incomplete combustion in a fire chamber, as may be accomplished in prior art stoves with adjustable draft, all to require cleaner burning in my stove.

I also provide an elongate baffle to aid the motion of combustion gases in theire horizontally orienteed cylindrical pattern. The baffle is of planar shape and positioned at the periphery of the combustion gas circulation cylinder, in a substantially tangential orientation to that cylinder, so that thea baffle tends to direct combustion gases back into the cylinder. This baffle is positioned at the upper part of the combustion cylinder for maximum effect, as in that area the hotter gases will be lighter than other other cooler gases within the combustion chamber and because of this difference in temperature the hotter, less dense gases will have a tendency to rise rather than move downwardly around the cylinder periphery except as prevented from so doing by the baffle. This is especially true in the upper forward portion of the combustion cylinder. The flue dampers of my invention are similarly configured and located adjacent to the upper rearward portion of the combusiton gas circulation cylinder to individually, and cooperatively with the baffle, aid in maintaining the cylindrical pattern of combustion gas circulation at this point. The effect of the dampers and baffle is synergetic and together the two accomplish substantially more than either would individually. The prior art, in general, has used slot-type draft dampers and baffles, but it does not appear that the two structures have been combined effectively in the same position and for the same purposes for which I use them.

The particular pocket form of my fire chamber that primarily and initially gives rise to the circular motion of combustion gases has a secondary benefit in that its surfaces are generally so defined as to tend to direct radiant energy striking them from burning fuel into that burning fuel to further enhance the combustion temperature and thereby aid burning efficiency. In general in stoves of the past, the radiant portion of the combustion energy has not been well considered and it merely has been dissipated as ultimate thermal energy rather than having been used to enhance the combustion process itself before being ultimately dispersed by a stove.

My invention lies not in any one of the foregoing structures of features, per se, but rather in the synergistic combination of all of them to provide the functions necessarily flowing therefrom as hereinafter more fully set forth and claimed.

SUMMARY OF INVENTION

My invention provides a stove having a vertically oriented front door with window and circulating air heat exchange means about its periphery.

The stove fire chamber has substantially uniform vertical cross-section defining a downward and rearward extending pocket in its rearward bottom portion to carry fuel and cause combustion gases to circulate in a horizontally oriented cylindrical pattern thereabove. An elolgate slit-type draft with medial angled divider is defined immediaately above and inwardly of the door and forwardly of the cylindrical combustion gas circulation pattern. Elongate baffles are positioned about the periphery of the combustion gas circulation cylinder, in its upper part, the aid in maintaining combustion gas circulation in that pattern. Elongate dampers of a plater type in flue exhaust ports serves a similar purpose. The peripheral walls defining the fire chamber provide heated surfaces to catalyze the combustion reaction and direct radiant energy back to the fuel source to increase its temperature.

In creating such a device, the objects of my invention are:

To provide a stove defining a fire chamber having a configuration to direct gaseous combustion products in a horizontally oriented cylindricl pattern to increase their transit time in the fire chamber to allow more complete combustion.

To provide a continuously open, divided, slit-type draft that is positioned to pass a split stream of input air over the inner surface of a door window and in a downward direction tangentialy over the surface of the combustion gas circulation cylinder.

To provide an elongate baffle in the upper forward part of the fire chamber, tangentially oriented to the combustion gas circualtion cylinder, to direct combustion gases in that chamber about the periphery of that cylinder.

To provide plural flue dampers that are positioned at the periphery of the combustion gas circulation cylinder, and angularly oriented in a tangential relation thereto, to tend to cause combustion gases to recirculate in that cylindrical pattern.

To provide such a fire chamber that has peripheral surfaces that are heated to provide additional catalytic activity for the combustion process and that are so oriented as to direct radiant energy from the combustion process back into the fuel being combusted to further increase its temperature and aid the combustion process.

To provide such a stove that is of a new and novel design, of rugged and durable nature, of simple and economic manufacture and otherwise well adapted to the uses and purposes for which it is intended.

Other objects of my invention will appear from the following specification and accompanying drawings which form a part hereof. In carrying out the objects of my invention, however, it is to be remembered that only a specific embodiment of the invention is set forth as required. Changes in design and structural arrangement and multiplication and ordering of parts may be resorted to without departing from its spirit, essence or scope, as it is intended that the invention be limited only by the appended claims.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 1:
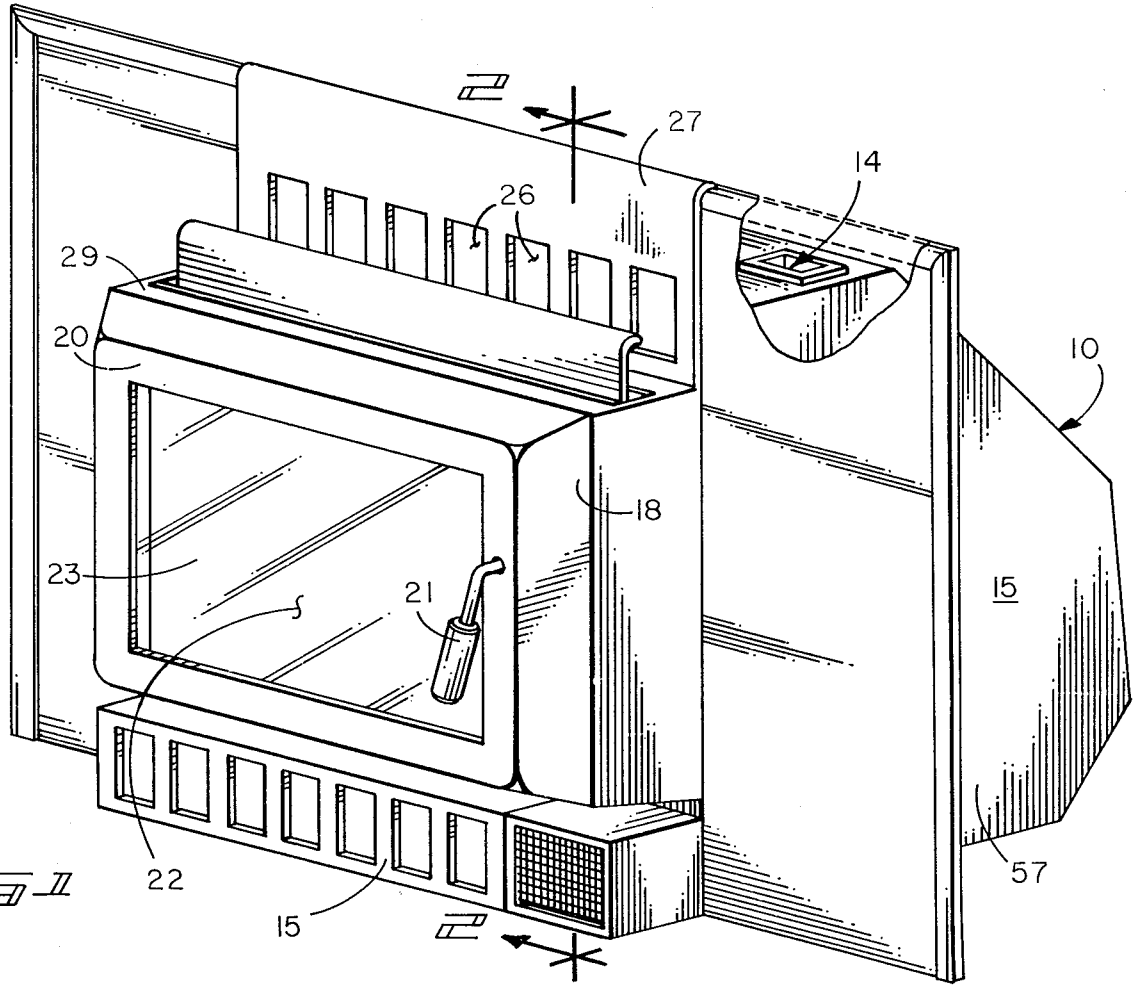
FIG. 1 is an isometric surface view of a typical stove of the fireplace insert type showing various of its parts, their configuration and relationship.

My invention generally provides stove 10 defining fire chamber 11 carrying internal baffle structure 13 therein and operatively communicating with draft system 12 and exhaust system 14.

Stove 10 provides outer peripheral shell 15 and inner shell 16, of similar but smaller shape and at least partially enclosed therein to define heat exchange chamber 17 therebetween. Forward wall 18 of the stove defines door orifice 19 which is closed by hingeably supported door 20 having latching means 21. Door 20 defines in its medial portion window opening 22 which carries transparent window 23, preferably formed of ceramic glass to avoid damage from the thermal environment within which it must exist. Normally window element 23 will be substantially planar and is sealably fastened within the opening carrying it. Door 20 has thermal gasket 58 positioned to contact forward stove wall 18 adjacent door opening 19 to provide a reasonably gas-tight seal between tahe door and adjacent stove wall.

Heat exchange chamber 17 provides means for circulating air about inner shell 16 to heat that circulated air. In the instance illustrated, lower input orifice 24 is provided with electrically powered fans 25 to force air received through orifice 24 through the heat exchange chamber and exhaust it through upper output orifice 26 into a room or other area to be heated.

In the instance illustrated the particular fireplace insert type stove provides forward, upward laterally extending face panel 27 to fit against an outer vertical surface of a fireplaces and allow the insert to be used in fireplaces having openings larger than the heat exchanger according to principles heretofore known in the fireplace insert art.

To the essential extent described, the structure of my stove is similar to most other stoves of present day commerce and in general, it may be readily substituted for them or used to replace them. This essential structure is not remarkable and does not constitute my invention, though it is required to provide means of operatively embodying my invention.

Fire chamber 11 is peripherally defined by inner shell 16 of the stove and is of a specialized configuration essential to my invention. The fire chamber generally is of uniform vertical cross-section. Forward portion 28 of the fire chamber is defined by the forwardly projecting portion of inner shell 16 providing forword stove wall 18 structurally communicating with the inner shell proper by upper horizontal wall 29 and lower downwardly angling walls 30. the lowermost fuel supporting portion of the fire chamber is defined by lowermost medial panel 31 joined to lower forward wall 30 by upwardly and forwardly angling panel 32 and joined to rearward panel 34 by upwardly and rearwardly angling rear bottom panel 33. Rear panel 34 angles slightly upwardly and forwardly ot structurally communicate with upper rearward panel 35 which angles more severely forwardly and upwardly. The upper edge of upper rearward panel 35 structurally commmunicates with horizonal top panel 36 which in its forward part communicates by vertical panel 37 with upper horizonal wall 29, all to define horizontally extending walls of the fire chamber illustrated in FIG. 2. Similar vertical ends 57 structurally communicate with the end portions of the horizontally extending walls to enclose the fire chamber with medial gas circulation area 38 and lower rearward pocket area 39.

The dimensioning of the various elements forming the periphery of fire chamber 11 is not absolutely critical, but must be considered relatively as this parameter relates to the dimensioning, and less critically to the configuration of draft 12 and exhaust system 14. In general, the relationship of these parameters is substantially the same as in the prior art relating to stoves and may be readily determined by known engineering methods. The exhaust orifices must be large enough to exhaust the combustion products from fuel burned in the fire chamber which generally requires a total exhaust area of about 10 percent of the area of a horizontal plane through the fire chamber. The area of the draft must generally be somewhat less than that of the exhaust orifice to cause both draft and exhaust elements to effectively serve their purposes.

Figures 2, 3:
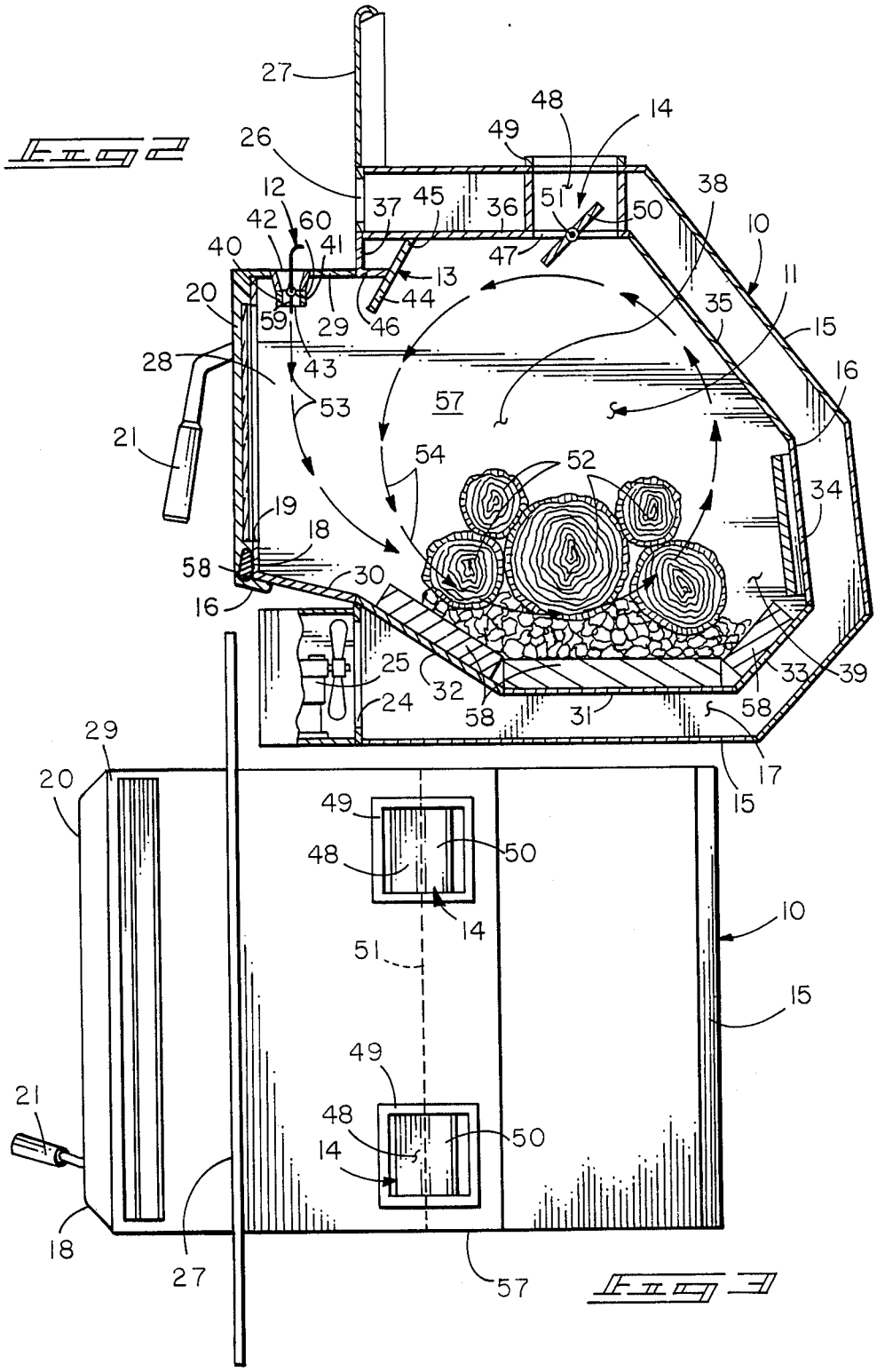
FIG. 2 is a vertical cross-sectional view of the stove of FIG. 1, taken on the line 2—2 thereon in the direction indicated by the arrows, to show the internal construction and operation of the device.
FIG. 3 is an orthographic top or plan view of the stove of FIG. 1, showing its various upper structures from this aspect.

The configuration and spatial array of the various panels forming the horizontally extending surfaces defining fire chamber 11 are also critical. Bottom panel 31 must be at or below the horizontal level of lower downwardly angling panel 30 for optimum operation and rearward panels 33, 34 and 35 should be angled approximately as illustrated in FIG. 2 to tend to cause thermal radiation incident upon those panels to be reflected back as much as possible into a fuel mass supported on the bottom panels. This combustion chamber configuration as illustrated also provides the rearwardly and downwardly extending pocket area 39 which, especially in cooperation with rearward panel 35, starts, facilitates and aids in miantaining the cylindrical flow pattern of combusting gases. The numerical details of these parameters again may be readily determined empirically or by ordinary known methods of analytical engineering.

The inner surfaces of bottom panels 30, 31, 32 and lower rearward panel 33 are preferably provided with appropiately sized and configured thermal protective material 58, commonly comprising commercially available fire brick. These panels receive substantial amounts of thermal energy and may deteriorate rather rapidly physically by reason thereof, if they be not somewhat protected.

The various elements forming inner and outer insert shells 16, 15 are formed of metal, preferably a mild steel, and if so formed they may be joined at interconnecting edges by welding. The only requirement for these elements is that they be appropriately rigid, heat resistant and structurally interconnected to fulfill their purposes and obviously other materials of an appropriate nature, such as ceramic, may be used, if not so conveniently, without departing from the essence or scope of my invention.

Draft 12 comprises an elongate rectilinear slot-type orifice defined by the insert, as illustrated, with similar spaced oppsed forward wall 40 and rearward wall 41 shaped to define larger input orifice 42 and smaller output orifice 43. This draft structure provides somewhat of a venturi-type action to provide some additional velocity for the draft input as it enters into the fire chamber to further aid its action. The draft is divided into two adjacent elongate input orifices by vertically extending divider 59 carried on rod 60 which is mounted for frictional motion in the ends defining the draft orifice, for frictionally controlled pivotal motion if desired. The divider has an upper inwardly curving portion **59*a*** to aid in collecting warmer air from above the insert to create greater turbulence in the draft input stream when its cooler forward portion mixes with its warmer rearward portion.

The draft structure is defined in the forward part of upper horizontal wall 29, immediately rearwardly of forward stove wall 18, and the draft structure extends downwardly from input orifice 42 defined in that upper horizontal wall. Normally, the areal extent of input orifice 42 will be larger than the areal extent of exhaust orifices 43. The downward extension of walls 40, 41 is not particularly critical, but normally they should not extend below the level of window orifice 22 defined in door 20 the draft air may not completely fulfill its purpose of keeping window 23 clear of thermal debris.

Baffle 13 comprises elongale rectilinear element 44 joined at its upper edge 45 to the undersurface of the forward portion of horizontal top panel 36 and angling forwardly and downwardly therefrom. Subframe element 46, in the instance illustrated comprising a rearward extension of upper horizontal wall 29, communicates with the rearward portion of the baffle to provide additional support and rigidity. The slope of this panel should be approximately forty-five degrees in a downward and forward direction, so that its surface is somewhat tangential to impinging circulation combustion gases that may pass thereunder and thereover.

Exhaust system 14 comprises two similar rectangular orifices 47 defined in the rearward portion of horizontal top panel 36. Exhaust channels are defined upwardly from orifices 47 by vertical walls 48 to commuicate with attachment lip 49 which facilitates the attachment of external flues or other exhaust conduits. Exhaust orifices 47 are provided with planar rectangular butterfly-type dampers 50 irrotatably carried by medial pivot rods 51 which in turn are journaled in the stove structure adjacent the vertical walls defineng exaust channels to allow the adjustable opening and closing of the exhaust orifices. Means as heretofore known (not shown) are provided for journaling and manually regulating the dampers 50. This damper control structure is not remarkable, does not constitute any essential part of my invention per se, and therefore is not illustrated or described in detail. Having thusly described my invention, its operation may now be understood.

A stove is created according to the foregoing specification and appended drawings. The operation of the stove is bestly understood with reference to FIG. 2. Elongate wood 52 of appropriate size and configuration is placed in the fire chamber through door 20 and upon bottom panels 30, 31 and 32 where it is to burn. An appropriate supply is placed in a reasonably consolidated amassed array to aid in supporting combustion and a fire is kindled therein by use of paper, kindling, combustible fluids or otherwise, as heretofore known. Dampers 50 are opened to create a large exhaust area so that initial combusting gases will tend to move upwardly through the exhaust rather than upwardly through draft structure 12.

As combustion gases tend to move through the exhaust system they will cause heating of both the exhaust channels and the gases in those channels. This heating will further enhance the draft action because the hot gases are less dense and will tend to move upwardly for ultimate exhaustation. As the burning continues, the exhaust gases that leave the fire chamber will have to be replaced by gas from the ambient atmosphere to maintain ambient air pressure within the fire chamber and that gas from the ambient atmosphere will tend to enter substantially through the draft orifice. This normal burning circulation will be established in a very short time after a fire is ignited in my stove, notwithstanding the fact that there is no means of closing draft 12.

As fuel in the stove enters into the combustion reaction, a circulatory pattern of combustion gases will be established as illustrated. The input air or draft will enter vertically downwardly through input orifice 43 of the draft structure. This air will tend to move vertically downwardly as it enters forward portion 28 of the fire chamber because firstly, it generally is heavier than the hotter air within the combustion chamber, and secondly, the Venturi action caused by the draft structure itself tends to create some velocity in the entering draft air to direct that air and cause it to more vertically downwardly. As the draft air moves within the fire chamber and approaches the forward lower wall 30, it will be diverted by that wall and will tend to move rearwardly toward the combustion area of the stove. This general motion of draft air is indicated generally by arrows 53.

This general motion the draft air, at the same time, will create some turbulence along its course to further enhance combustion. The forward portion of the draft orifice will tend to input cooler air from in front of the insert and the rearward portion will input warmer air that has been heated by moving over the insert structure rearwardly of that orifice. These different temperature air streams in the draft will physically inter-react to cause the indicated turbulence along their course.

As the draft air impinges upon the burning fuel, it enters into the combustion process. Some of that air, and gaseous and suspended particulate combustion products, then exit from the combustion area. The general exit pattern will be upwardly and somewhat rearwardly because of the velocity and direction of the input draft air and the shape of the combustion chamber. Primarily, however, the exhaust gases will move upwardly because they are heated in the combustion process and therefore are less dense than the cooler gases thereabout.

As the gases move upwardly, will be diverted, especially by upper rearward panel 35, in a somewhat forward direciton. A smaller portion of those gases will pass vertically upwardly through exhaust orifices 47 and the other larger portion will pass forwardly of those exhaust orifices toward baffle 13 which will divert them in a downward direction. This action is further enhanced by the angled dampers in the exhaust channel as seen in the illustration of FIG. 2. As this gas motion continues, it will be aided by the motion of the incoming draft air which tends to divert the combustion gases in the upper forward part of the combustion chamber back into the area of the combustion fuel 52. This general circulatory motion of combustion gases is illustrated in a somewhat idealized fashion by the series of arrows 54.

It is to be remembered that the circulation is illustrated on a particular vertical plane, but it is substantially the same on all vertical planes through my stove, so as to provide a three dimensional circulatory pattern in the nature of a horizontally orientated circular cylinder.

This circulatory pattern will continue, and in fact be enhanced, as the combustion process proceeds and the temperature of the stove and exhaust system raise. This particular circulatory pattern of gases within the fire chamber combines the better combustion features of both an updraft and downdraft-type stove, but yet adds a further element in causing the cylindrical circulation pattern indicated, as with this, the combustion gases on the average remain within the combusiton chamber substantially longer than with either an updraft or a downdraft-type stove not having the feature. Because of the longer average residency of combustion gases within the combustion chamber, the efficiency of combustion is substantially enhanced and it moves to a degree of completion not obtainable in other types of stoves.

The combustion process is further enhanced by the particular configuration of insert components. The particular angulated array of the various elements defining inner shell 16 tends to direct radiant energy provided by the combusting fuel back toward the area of combustion. This tends ot increase the temperature in the area of primary combustion activity to again cause a more efficient and complete total combustion process. In general in stoves off the past, the radiant energy produced by the combustion process has not particularly been considered in relation to increasing the efficiency of that process, but rather in general has been diverted toward heating of the stove itself or objects adjacent to it.

The combustion action is further enhanced by the metal structures defining the upper portion of the fire chamber, and particularly horizontal top plate 36, baffle 13 and damper 14. These elements are heated both by radiant and convection heat and are raised to substantial temperatures. As this occurs, the surfaces themselves, or at least the thermal energy in the elements forming them, tend to act as catalysts to further enhance the combustion reaction in the impinging, incompletely combusted gases passing thereover and thereabout. This action again tends to enter into a synergistic relationship with the other stove functions to provide a combustion reaction that proceeds toward completion substantially more than in other present day wood burning inserts not embodying my invention.

The foregoing description is necessarily of a detailed nature to specify a preferred and practical embodiment of my invention as is required. It should be remembered, however, that various modifications of detail, rearrangement and multiplication of arts might be resorted to without departing from the spirits, essence, or scope of my invention.

Having thusly described my invention,

What I claim is:

1. A stove that circulates combustion gases in a horizontal cylindrical fashion to provide a longer dwell time in the fire chamber, comprising in combination:

an outer shell partially containing an inner shell, with door means in the inner shell at a spaced distance from the outer shell, to define a heat exchange chamber between the inner and outer shells, said heat exchange chamber having means to circulate air therethrough for heating;

a fire chamber defined by the inner shell and having a forward portion, a bottom portion extending rearwardly and below the forward portion in an angulated fashion, a rearward portion angled in an upward and forward direction, a forwardly extending substantially horizontal top plate and a forward vertical wall defining the aforesaid door means;

draft means defined in the top plate above and immediately rearwardly of the door means;

and flue means for exhausting combustion gases from the upper rearward part of the fire chamber defined a spaced distance forwardly of the rearward portion of the fire chamber.

2. The invention of claim 1 further characterized by a baffle depending a space distance from the medial forward portion of the upper horizontal plate, said baffle constituting a planar element angled downwardly and forwardly from its interconnection with the top plate.

3. The invention of claim 1 further characterized by:

at least two spaced exhaust channels defined in laterally spaced relationship in the rearward portion of the upper plate with butterfly-type dampers pivotally supported therein, said dampers projecting downwardly therefrom at an upward and rearwardly extending angle during use and for adjustable closure, and the bottom portion of the inner shell having thermally resistive material thereon to support fuel to be burned in the fire chamber.

4. The invention of claim 1 wherein the draft comprises an elongate channel having vertical extension with an entry orifice larger than the exit orifice into the fire chamber and with a sheet-like divider therein to divide the draft channel into two similar elongate portions.

5. A fire chamber for a wood burning stove that circulates combustion gases in a horizontal cylindrical pattern to provide a longer dwell time in the fire chamber, comprising in combination:

a vertically medial, forward portion with a vertical forward wall defining door means and an elongate slot-like draft at the upper part of the forward portion immediately rearwardly of the vertical forward wall, said slot-like draft having a divider therein to create two adjacent channels;

a lower portion having a fuel supporting surface below the forward portion and defining a rearwardly extending pocket area;

a rearward portion defining a wall sloping upwardly and forewardly; and an upper horizontal portion defining two spaced exhaust channels in its rearward portion and carrying a forwardly and downwardly extending baffle in its forward portion rearwardly of the draft structure.

6. The invention of claim 5 further characterized by:

the slot-like draft defining a vertical channel with upper input orifice larger than lower output orifice to create a Venturi action therein.

7. The invention if claim of claim 5 further characterized by:

the similar spaced exhaust channels having adjustable butterfly-type damper therein, said dampers being pivotal about an elongate medial rod to regulate the effective output area of the exhaust channel.

* * * * *